US006426709B1

(12) United States Patent
Becker et al.

(10) Patent No.: US 6,426,709 B1
(45) Date of Patent: Jul. 30, 2002

(54) METHOD FOR TRANSMITTING LOCAL DATA AND MEASUREMENT DATA FROM A TERMINAL, INCLUDING A TELEMATIC TERMINAL, TO A CENTRAL TRAFFIC CONTROL UNIT

(75) Inventors: Markus Becker, Essen; Ulrich Fastenrath, Düsseldorf, both of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/319,604

(22) PCT Filed: Dec. 8, 1997

(86) PCT No.: PCT/DE97/02909

§ 371 (c)(1),
(2), (4) Date: Jun. 9, 1999

(87) PCT Pub. No.: WO98/26397

PCT Pub. Date: Jun. 18, 1998

(30) Foreign Application Priority Data

| | | |
|---|---|---|
| Dec. 9, 1996 | (DE) | 196 52 419 |
| Mar. 6, 1997 | (DE) | 197 11 104 |
| Dec. 4, 1997 | (DE) | 197 55 875 |

(51) Int. Cl.[7] ..... G08G 1/123

(52) U.S. Cl. ..... 340/992; 340/988; 340/989; 340/990; 701/200; 701/207; 701/213

(58) Field of Search ..... 340/992, 993, 340/988, 989, 990, 991; 370/477; 348/14.13; 707/101; 701/200, 201, 207, 213, 216

(56) References Cited

U.S. PATENT DOCUMENTS

| | | | | |
|---|---|---|---|---|
| 4,009,375 A | * | 2/1977 | White et al. | 235/150.24 |
| 5,119,102 A | * | 6/1992 | Barnard | 342/357 |
| RE35,498 E | * | 4/1997 | Barnard | 342/357 |
| 5,699,255 A | * | 12/1997 | Ellis et al. | 364/449.6 |
| 5,712,899 A | * | 1/1998 | Pace, II | 379/58 |
| 5,719,771 A | * | 2/1998 | Buck et al. | 364/443 |
| 5,933,100 A | * | 8/1999 | Golding | 340/995 |
| 5,974,356 A | * | 10/1999 | Doyle et al. | 701/209 |
| 6,012,013 A | * | 1/2000 | McBurney | 701/207 |

* cited by examiner

*Primary Examiner*—Jeffery Hofsass
*Assistant Examiner*—Toan Pham
(74) *Attorney, Agent, or Firm*—Cohen, Pontani, Lieberman & Pavane

(57) ABSTRACT

A reduction in telecommunications costs in the transmission of extensive data from a telematic terminal unit in a vehicle to a central station is made possible by a method for the transmission of location data implicating the location of the terminal unit in a traffic network at a point in time and of measurement data impliciting other characteristics of the traffic network at a location and/or at a time to the central traffic station, which location data and measurement data are detected by the terminal unit, particularly a telematic terminal unit for a vehicle. At least some of the data records transmitted from the terminal unit to the central traffic station contain only location data and some of the data records transmitted from the terminal unit to the central traffic station contain measurement data.

20 Claims, 3 Drawing Sheets

METHOD FOR TRANSMITTING LOCAL DATA AND MEASUREMENT DATA FROM A TERMINAL, INCLUDING A TELEMATIC TERMINAL, TO A CENTRAL TRAFFIC CONTROL UNIT

BACKGROUND OF THE INVENTION

Field of the Invention

The invention is directed to a method for the transmission of location data and measurement data from a terminal unit, especially a telematic device, to a central traffic control.

The use of vehicles driving along in traffic in a traffic network for the purpose of acquiring traffic data (FCD= floating car data) for a traffic detection and forecast center requires transmission of data from the vehicle to the traffic forecast center via mobile radio or the like. In so doing, a vehicle (FC) transmits to a central traffic control data implicating the location of the vehicle at a plurality of successive points in time, possibly including data impliciting each point in time, as well as measurement data detected by the vehicle, for example, speeds, average speeds for a trip, temperatures and the like, at determined points in time at determined locations or between determined locations at which the terminal unit is located at these points in time. However, the telecommunications costs entailed in the transmission from the terminal device to a central traffic station are relatively high.

SUMMARY OF THE INVENTION

The object of the present invention is to reduce the telecommunications costs in the transmission of data from a terminal unit to a central traffic station in a simple, economical and efficient manner.

The invention leads to a reduction in occurring telecommunications costs. Location data impliciting the location of the terminal unit in a traffic network at a respective point in time and measurement data impliciting characteristics of the traffic network at a location and/or at a point in time are transmitted from the terminal unit independently from one another. In this respect, location data on the one hand and measurement data on the other hand can be combined prior to a transmission to form location data records and measurement data records which contain a measurement datum or a location datum or measurement data and location data at different locations and points in time. In particular, characteristics of the traffic network at a location and/or at a point in time which are implicited by measurement data may be data indicating a backup and/or a travel time and/or a possible driving speed and/or a temperature and/or precipitation at a location and/or the point in time of a location (of a vehicle) in the traffic network. The location may be indicated by a determined location point or by a location area (that is, a partial section within the traffic network) which is indicated, for example, by several points. The time to which characteristics of the traffic network implicited by measurement data can refer, for example, may be indicated by a point in time or by a time range in the form of a plurality of points in time. Data records with measurement data can contain a reference datum of a given type for correlating the measurement data in the central station to a position, for example, in a digital map of the traffic network; a referencing of this type can relate to the location of the traffic network and/or to the point in time to which the measurement data relate based on their measurement. A terminal unit according to the invention can be, for example, a telematic device for a vehicle, which telematic device can be constructed for detecting traffic data and/or receiving traffic data from a central traffic station.

With respect to transmission from a terminal unit to a central traffic station, the method according to the invention enables optimum utilization of cost-intensive telecommunications times, whose availability may also possibly be limited. The total amount of data to be transmitted is reduced through the mutually independent compression and transmission of data records containing only location data and data records containing measurement data. Moreover, it is possible to adapt to local requirements; for example, on a straight stretch of highway without exits or entrances, transmission of location data is useful or meaningful only at relatively long time intervals or spatial intervals, so that, in this case, possibly more measurement data (about speeds, backups, icy roads, etc.) than location data may be transmitted. On the other hand, in an urban area, for example, it may be advisable to transmit location data at short time intervals and/or spatial intervals because there is a relatively large number of possible turns for the vehicle which require a relatively frequent transmission of location data for complete detection of the path of the vehicle in the city, so that in this case possibly more location data than measurement data must be transmitted. However, individual data records can contain location data and measurement data at points in time when location data and measurement data for transmission occur.

The length of a data record containing only location data and/or of a data record with measurement data advisably varies. The location referencing and time referencing of data records with respect to location data and of data records with respect to measurement data can differ. In particular, referencing can relate to a location or point in time or a location area or time range. The transmission is advisably carried out by mobile radio. The transmission of data records from the terminal unit to the central traffic station as a short message (e.g., GSM SMS), which allows extensive universality and automatic further processing in the central traffic station is particularly advantageous.

The times when data records with location data and/or with measurement data are transmitted can be defined by different, predeterminable conditions in the terminal unit: a transmission of measurement data records from the terminal unit to the central traffic station can be carried out when an event of a type predetermined in the terminal unit takes place. In particular, an event of this kind can take place when the speed of the vehicle in which the terminal unit is located falls below a speed value, when falling below or exceeding one of several speed values, when driving along a sharp curve (with a sharp turning of the steering wheel and/or a change in the driving direction of the vehicle in which the terminal unit is located, which change is detected by GPS), at the expiration of a time interval (after which a transmission of measurement data must take place), or the like, in order to enable automation.

The transmission of a location data record can be carried out at the expiration of a defined time interval and/or at the occurrence of another event. Accordingly, location data can also be transmitted, for example, when a vehicle containing a terminal unit passes a given location (out of a plurality of predeterminable locations), that is, for example, a determined highway junction. In this respect, the passing of a determined location can take place based on a digital map in the terminal unit and/or based on the position of the terminal unit detected by GPS or the like. In addition to this or instead of this, a transmission of location data from the terminal unit to the central traffic station is also useful when the vehicle in which the terminal unit is located has traveled over a certain section or when a change in direction has been carried out (which can be detected by a turning of the steering wheel and/or by continued location detection in the terminal unit) because it is important precisely in this case to transmit a new location data record for determining the path of the terminal unit for the central traffic station.

The method according to the invention can be implemented in a terminal unit and/or in a central traffic station.

Further features and advantages of the invention are indicated in the following description of an embodiment example with reference to the drawing.

DETAILED DESCRIPTION OF THE PREFERRED EMBODIMENTS

Figure 1:
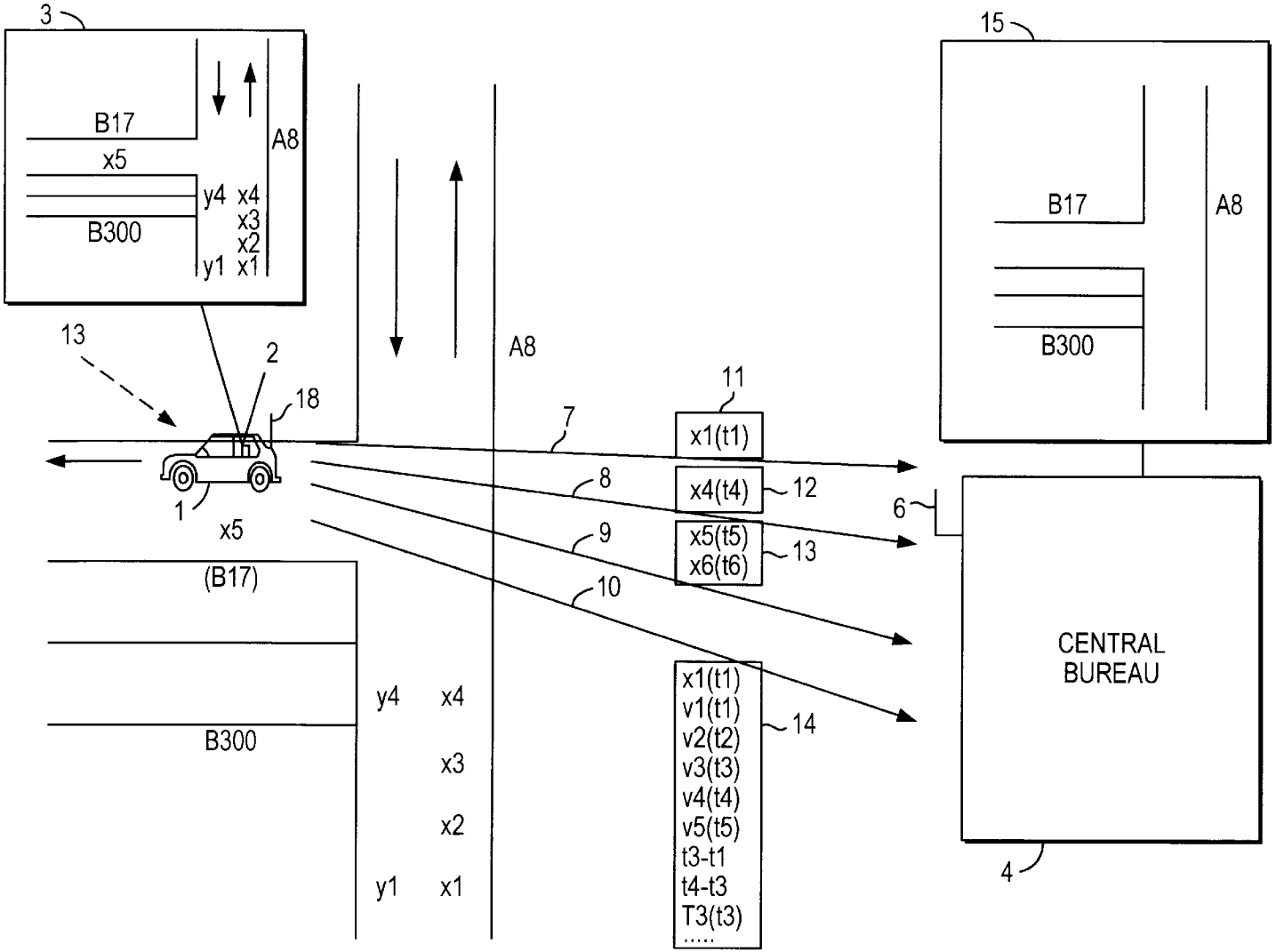
FIG. 1 shows a schematic view of a vehicle moving in a traffic network and having a terminal unit which transmits data to a central station.

FIG. 1 shows a vehicle 1 with a terminal unit 2 according to the invention which detects location data (GPS 3), the vehicle speed v and distance traveled s, as measured by the vehicle 1, the outside temperature T (at the vehicle 1), and the time t (measured by a digital clock etc. in the terminal unit or vehicle). The vehicle 1 moves in a traffic network, of which only sections are shown and which includes a highway A8 and federal roads B300, B17, wherein the vehicle 1 passes successively in time (t) through its vehicle locations x1 (t1), x2 (t2), x3 (t3), x4 (t4), x5 (t5) at times t1 to t5. Location data relating to locations x1 to x5 etc. of the terminal unit 2 and measurement data measured by the terminal unit are to be sent by the terminal unit 2 at times t1 to t5 to the central traffic station 4, where traffic data from a plurality of vehicles and, if required, other data (for example, from stationary detectors in the traffic network) can be used for traffic detection, traffic forecasting and/or individual vehicle navigation. The transmission 7, 8, 9 of location data and the transmission 10 of measurement data from the terminal unit 2 to the central station 4 is carried out by radio, in this case mobile radio (antenna 18 of the terminal unit 2, antenna 6 of the central traffic station 4). For this purpose, a digital data format, namely a mobile radio short message format (GSM SMS) is used for the transmission 7, 8, 9, 10.

In order to optimize the occurring telecommunications costs for transmission 7, 8, 9, 10, location data and measurement data are handled separately.

In so doing, data for a data record with location data and for a data record with measurement data can be used in the terminal unit 2. This can apply in particular for referencing data used for referencing location data and/or measurement data. Referencing data can reference the time and/or the location to which location data and/or measurement data relate. A location can be indicated as a location point or as a location area (x1, x2); a time can be represented as a time point t1 or as a time span t1, t5. The referencing of location data and measurement data serves to enable correlation of location data x1 to x5 and measurement data v1 . . . v5, T1 (t1), etc. in the central traffic station 4.

Accordingly, data are allocated to one or both of two data containers. One data container is provided for location data impliciting the location of the terminal unit at different times; a second container is provided for measurement data implicating other measurement data of the terminal unit, particularly speeds, temperatures, travel times, etc.

Location data and/or measurement data can be further processed, if necessary, prior to transmission (7 to 10) in the terminal unit 2.

Prior to transmission 7 to 10 from the terminal unit 2 to the central office 4, data are sorted into data records (or container 1) relating only to location data and data records relating to measurement data. In particular, location data and/or time data can be allocated to both data records, if necessary. Further, if required, additional data such as designation of type of vehicle, etc. can be included in the transmission 7 to 10. For initiating a transmission 7 to 10, different criteria can be defined for data records 11 to 13 relating only to location data and for data records 14 relating to measurement data.

With respect to location data records, for example, it can be defined that a transmission is carried out when the current location x1 corresponds sufficiently accurately to a location y1 given in the terminal unit 2. In particular, a pertinent location of this type given in the terminal unit can be the start y1 of a highway A8 or the location of an exit y4 for an interstate road B300 from a highway A8 or the like. Instead of this, or in addition to this, a terminal unit 2 can initiate a transmission when the driving direction of the terminal unit 2 or vehicle 1 changes. The change in the driving direction can be detected through continuous evaluations on the part of the terminal unit of GPS data 3 and/or through a turning angle of the steering wheel of a given extent with respect to the anticipated speed on the highway A8, wherein, in this case, if necessary, a digital map can be used, in addition, in the terminal unit 2 for checking whether a curve occurs on the road A8 currently traveled by the terminal unit 2 and/or whether it is possible to exit or whether there is a highway rest stop, etc. Further, when the vehicle is not caused to indicate its location for other reasons, it is also possible to cause transmission at defined time intervals and/or distances.

When location data x1, x4, x5 which are transmitted from the vehicle 1, or terminal unit 2, to a central station 4 for determining location, the path of the terminal unit 2 can be determined in the central station 4 in a digital map 15. In this case, inaccuracies or gaps in the determination of the location of the terminal unit 2 can be supplemented by plausibility checks by means of the map 15. For example, the most likely path of a terminal unit 2 between two points x1, x5 known to the central station 4 can be determined based on roads extending between these two points x1, x5. In particular, different spatial and/or temporal interpolation methods can be carried out with the data x1 (t1), x4 (t4), x5 (t5) transmitted to the central bureau.

Further, different measurement data such as speeds, temperatures, travel times between two points, etc. are detected by the terminal unit 2. Different presets can be implemented alternatively or together in the terminal unit 2 to trigger the transmission of a data record with measurement data. For example, a transmission of travel times can be carried out when the actual travel time of the terminal unit t4–t1 between two given points y1, y4 exceeds a preset value stored in the terminal unit 2. Further, a transmission from the terminal unit to the central station can be triggered when the speed of the terminal unit 2, possibly depending on the type of vehicle 1, falls below or exceeds one of possibly several thresholds given in the terminal unit 2. A transmission can also be triggered at a given temperature, for example, at freezing point or at a temperature above the freezing point.

Measurement data (speeds, travel times, temperatures, etc.) detected by the terminal unit 2 and transmitted as a data record 14 are correlated in the central station 4 with positions in the digital map 15 in the central station 4. When the location x1 to x5, etc. detected (GPS 3) by the terminal unit 2 is indicated and transmitted in a data record 14 with measurement data for every measurement datum, it is possible to directly correlate with positions in the map 15 in the central station 4. Further, it is possible to correlate based on times sent for individual measurement data taking into account the route, that is locations x1, x4, x5 of the vehicle 1. In this way, measurement data can be correlated with determined locations x1 to x5 on the route of the vehicle 1 on the digital map 15. When measurement data in a measurement data record 14 are compared in the central station 4 with the path x1, x4, x5 traveled by a vehicle 1 for correlation or for monitoring the correlation with positions in the digital map 15, it is advisable that a vehicle identification is also transmitted for every location data record 11, 12, 13 and for measurement data records 14 in order to make it possible to correlate the measurement data records with location data records in the central station 4 for a specific vehicle 1; for example, the identification can consist of a mobile radio number of the terminal unit or a virtual number.

An example of the reconstruction of a route and behavior of a vehicle based on transmitted data will be described in the following for additional information.

1. Problem Statement

The starting point for the reconstruction problem is a discrete series $$PRH=(PR_i)_{i=1} \ldots N$$

of point-related route reference points (Position Report History, PRH) and a spatially and temporally matching discrete series $$SRH=(SR_j)_{j=1} \ldots M$$

of section-related driving profile reference points (Section Report History, SRH). The route reference points and driving profile reference points possess the attributes[1] specified in the following table:

TABLE 1

Attributes of route reference points and driving profile reference points

| Type of reference point | Attribute | Symbol | Explanation |
|---|---|---|---|
| PR | Latitude | $\lambda$ | geographic latitude |
| | Longitude | $\psi$ | geographic longitude |
| | Time Stamp | T | absolute time |
| | Heading | $\alpha$ | direction |
| | Distance | S | distance from (temporal) end of route in the direction opposite to the driving direction |

Only those attributes relevant to the solution of the present reconstruction problem are listed.

TABLE 1

Attributes of route reference points and driving profile reference points

| Type of reference point | Attribute | Symbol | Explanation |
|---|---|---|---|
| SR | Distance | S | distance from (temporal) end of route in the direction opposite to the driving direction |
| | Time Stamp | T | absolute time for the start of the section in the driving direction (arrival time) |
| | Spatial Extension | $\Delta s$ | spatial extension of the section on the route |
| | Temporal Extension | $\Delta T$ | temporal extension of section |
| | Section Data Item | F | profile data related to section |

The two series PRH, SRH are indicated in a temporally descending sequence with respect to the time stamp attribute of their terms $PR_i$, $SR_j$ $$T(PR_{1+1}) \leqq T(PR_i),$$

$$T(SR_{j+1}) \leqq T(SR_j).$$

Figure 2:
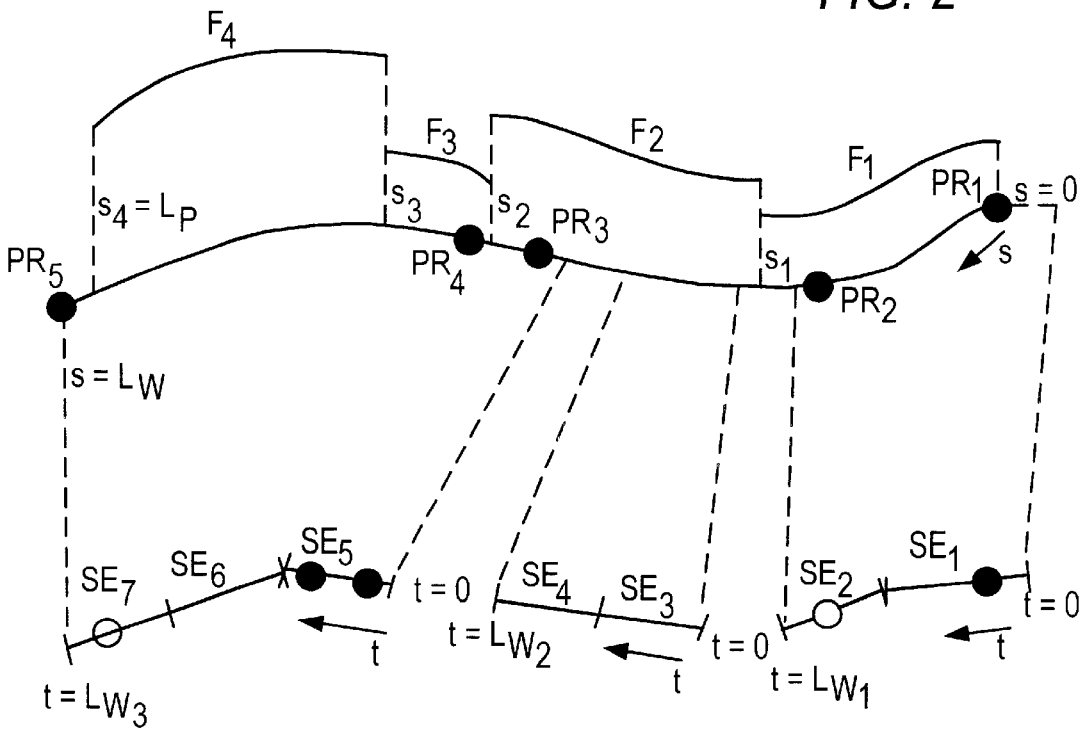
FIG. 2 is an illustration of a reconstruction problem.

FIG. 2 illustrates the reconstruction problem with reference to a description of the original route ($\lambda(s)$, $\phi(s)$) (geographic longitude and latitude) in the form of five route reference points $PR_1, \ldots, PR_5$ and a description of the driving profile $F(s)=f(\lambda(s), \phi(s))$ in the form of four driving profile sections $SR_1, \ldots, SR_4$.

The distance s of the path points along the route from the end of the route in the direction opposite to the driving direction functions as path parameter on the original route. For the value range of this path parameter with respect to the route:

$$s \in [0, L_W],$$

$$L_W = S(PR_N).$$

And with respect to the driving profile:

$$s \in [0, L_p],$$

$$L_P = \Sigma_j^M \Delta S(SRP_j).$$

The profile sections succeed one another continuously along the route, that is:

$$S(SR_{j-1}) + \Delta S(SR_j) = S(SR_j), j=2 \ldots M.$$

The individual driving profile sections characterize the driving profile with reference to the average[1] $F_j$ of the profile measurement values $$\{F(s) | s \in [S(SR_j), S(SR_j) - \Delta S(SR_j)]\}.$$

By reconstruction, i.e., a solution to the reconstruction problem, is meant a series of section elements of the given representation of the road network which best illustrate the route described by the PRH and the driving profile described by the SRH on the road network.

Section elements which form a component of a reconstruction have values for the following attributes:

TABLE 2

Attributes of a Section Element

| Type | Attribute | Symbol | Explanation |
|---|---|---|---|
| static | Latitude, starting position | $\lambda_a$ | geographic latitude |
| | Longitude, starting position | $\psi_a$ | geographic longitude |
| | Latitude, end position | $\lambda_e$ | geographic latitude |
| | Longitude, end position | $\psi_e$ | geographic longitude |
| | Length | L | length |
| dynamic | Time Stamp | T | absolute time for the start position (arrival time) |
| | Travel Time | TT | travel time on the section element |
| | Section Data Item | F | profile datum relating to the section element |

This can also relate to a plurality of driving profile data which are independent from one another and which can be combined in a vector field F(s).

The static attributes come from the network description (where-question); the dynamic attributes serve for producing a time reference (when-question) and correlation of profile data (how-question) for the section elements. The series R is sorted, with respect to the time stamp attribute of its sequence terms $SE_k$, in a temporally descending sequence, that is:

$$T(SE_{k+1}) \leqq T(SE_k), k=1 \ldots (A-1).$$

2 Reconstruction Relations

In this section, some general relations forming the basis for the solution of the reconstruction problem (reconstruction relations) will be defined. The aim is to express the dynamic attributes of the series terms $SE_k \in R$ of the reconstruction as values of reconstruction relations arranged in suitable series.

2.1 Time Interpolation Mapping T

The time interpolation mapping T(s) represents a continuous interpolation with respect to all discrete time indications from PRH and SRH, i.e., there is allocated to every point $s \in [0, \mathrm{Max}(L_W, L_P)$ along the original route an approximation T(s) for the time point at which the point was passed by the floating car. Let the series of time stamps of $PR_i \in$ PRH and $SR_j \in$ SRH indicated in temporally descending sequence be designated by $$(t_I)_{I-1} \ldots (N+M),$$

$$t_I \in \{T(PR_i) | i=1 \ldots N\} \cup \{T(SR_j) | j=1 \ldots M\},$$

$$t_{I+1} \leqq tI$$

and let the series of associated values of the path parameter s be designated by $$(S_I)_{I=1} \ldots (N+M),$$

$$_I \in \{S(PR_i) | i=1 \ldots N\} \cup \{S(SR_j) | j=1 \ldots M\},$$

$$_{I+1} \leqq s_I,$$

then T(s) must satisfy the following boundary conditions:

$$T(s_I)=t_I, I=1 \ldots (N+M).$$

Moreover, T(s) is model-dependent. The simplest time interpolation mapping interpolates linearly (constant speed) between two successive time stamps $t_I$, $t_{I+1}$ and can be defined section wise as follows:

$$T(s)==\alpha_I+\beta_I \cdot s,\ s_I \leqq s < s_{I+1}, I=1 \ldots (N+M-1),$$

$$\alpha_I = \frac{t_I s_{I-1} - s_I t_{I+1}}{s_{I+1} - s_I}, \quad \beta_I = \frac{t_{I+1} - t_I}{s_{I+1} - s_I}.$$

Figure 3:
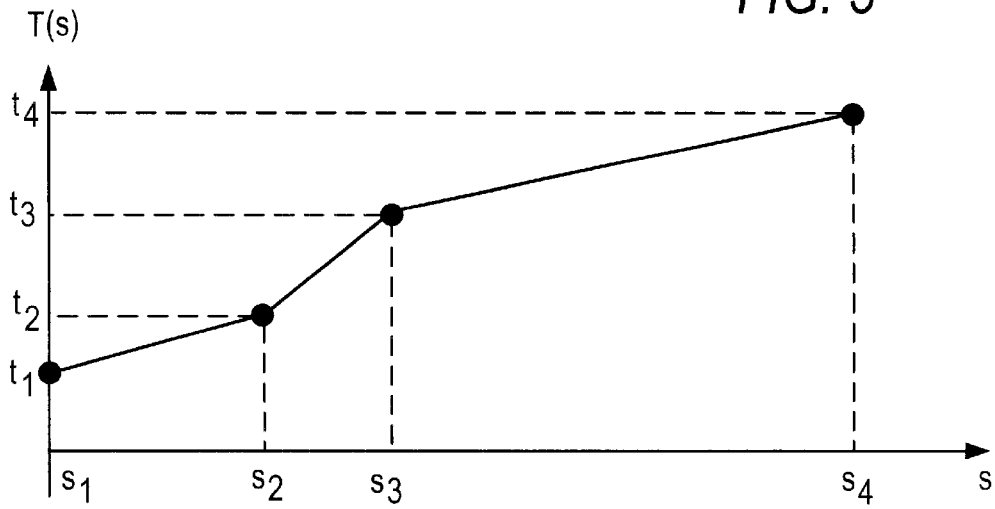
FIG. 3 is an illustration of time interpolation mapping T(s)

This time interpolation mapping is illustrated in FIG. 3.

2.2 Profile Interpolation Mapping F

The profile interpolation F(s) represents a continuous interpolation with respect to the discrete driving profile data $\{F(SR_j) | j=1 \ldots M\}$, i.e., there is allocated to every point $s \in [0, L_p]$ of the original route an approximation F(s) for the value possessed by the original driving profile at this point.

Like T(s), F(s) is model-dependent; the simplest profile interpolation mapping interpolates by step function, i.e., it is defined section wise as follows:

$$F(s)=F_j,\ s_{j-1} \leqq s < s_j,\ j=1 \ldots M,$$

$$s_j=S(SR_j),\ s_0=0,$$

$$F_j=F(SR_j).$$

Figure 4:
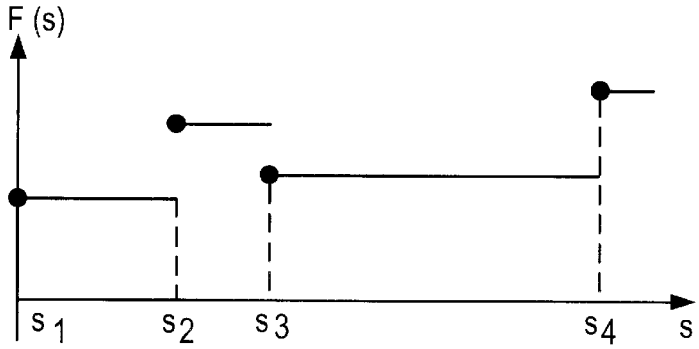
FIG. 4 is an illustration of profile interpolation mapping F(s)

This profile interpolation mapping is illustrated in FIG. 4.

2.3 Projection Relation P

The projection relation P is a series of ordered pairs $$P=(P_c)_{c=1 \ldots c},$$

$$p_c=(PR_c, SE_c)$$

which allocates to elements $PR \in$ PRH section elements SE from the quantity NB of network display elements. There is a projection relation between a $PR \in$ PRH and an $SE \in$ NB when one of the following conditions is met:

P1: The geo-position described by PR meets the projection criteria, i.e., they can be projected on the section element SE (reference section element).

P2: None of the geo-positions from $PR \in$ PRH meets the projection criteria with respect to the section element SE, but the latter is a component part of the reconstructed route. In this case, the $PR \in$ PRH having the least positive distance in time from the start of SE, considered in the direction in which SE (interpolating section element) is driven through, is in a projection relation with SE.

Pairs (PR, SE) $\in$ P, for which the condition P1 (P2) is met (conditions P1, P2 are mutually exclusive) are characterized by the attribute projected=true, false and, moreover, receive (do not receive) an indication relating to the distance of the geo-position described by the PR from the start of SE (considered in the drive-through direction) after projection on the section element.

The series $P=(P_c)_{c=1 \ldots c}$ is sorted according to the time stamp attribute of the components (PR, SE) of its series terms in a temporally descending sequence. The specification of the projection criteria and of the algorithm established by the projection relation for a PRH and an SRH are not the subject matter of the present Application.

The projection relation for the example from Diagram 1 is shown in the following table:

TABLE 3

Projection relation for the example trom Diagram 1

| Pair index | Index PR | Index SE | Attribute distance | Attribute projected |
|---|---|---|---|---|
| 1 | 1 | 1 | $x_1$ | true |
| 2 | 2 | 2 | — | false |
| 3 | 2 | 3 | — | false |
| 4 | 2 | 4 | — | talse |
| 5 | 3 | 5 | $x_5$ | true |
| 6 | 4 | 5 | $x_6$ | true |
| 7 | 4 | 6 | — | false |
| 8 | 5 | 7 | — | false |

As shown by this example, a projection relation P can allocate several position reports to one section element and, conversely, can allocate one position report to several section elements.

2.4 ZTA Relation

The ZTA relation (ZTA=contiguous partial sections with space point) is a ty of partial series of the projection relation P $$ZTA=\{ZTA_z|z=1 \ldots Z\},$$

$$ZTA_z=(P_{z,r})_{r=1 \ldots Rz}$$

$$P_{z,r}=(PR_{z,r}, SE_{z,r}) \in P$$

which satisfies the following ZTA criteria:

ZTA1: Every partial series $ZTA_z \in ZTA$ is indicated per se with respect to the time stamp attribute of its series terms $p_{z,r}=(PR_{z,r}, SE_{z,r})$ in temporally descending sequence, i.e., $T(SE_{z,r+1}) \leqq T(SE_{z,r})$ is true for $PR_{z,r+1} \neq PR_{z,r}$ and $T(SE_{z,r+1}) \leqq T(SE_{z,r})$ is true for $SE_{z,r+1} \neq SE_{z,r}$. Further, the partial series $ZTA_z \in ZTA$ are likewise indicated in themselves in temporally descending sequence.

ZTA2: The series of section elements $SE_{z,r}$ of a partial series $ZTA_z \in ZTA$ form a contiguous partial section of the route reconstruction, i.e., $$\lambda_a(SE_{z,r})=\lambda_e(SE_{z,r+1}),\ r=1 \ldots (R_z-1),$$

$$\phi_a(SE_{z,r})=\phi_e(SE_{z,r+1}),\ r=1 \ldots (R_z-1)$$

are true for $SE_{z,r+1} \neq SE_{z,r}$.

ZTA3: There exists for every partial series $ZTA_z \in ZTA$ at least one projection relation $P_{z,r}=(PR_{z,r}, SE_{z,r}) \in ZTA_z$ whose projected attribute has the value "true".

The ZTA criteria clearly signify that the section elements $SE_{z,r}$ of every partial series which contain the ordered pairs $P_{z,r}=(PR_{z,r}, SE_{z,r}) \in ZTA_z$ form a contiguous partial section and at least one $PR_{z,r}$ could be projected on a section element. That pair $P_{z,r}=(PR_{z,r}, SE_{z,r}) \in ZTA_z$ of every partial series $ZTA_z \in ZTA$ for which the condition of ZTA3 is met for the first time in the direction of temporal drive-through is designated as the space point projection.

The ZTA series contains the partial series of the projection relation for which time references can be produced. This is clear from the example of Diagram 1: (one or more) so-called missing segments lie between section elements 2/3 and between section elements 4/5, i.e., the projection relation P is divided into three partial series, two of which meet the ZTA criteria:

$$ZTA=\{ZTA_1, ZTA_2\}.$$

$$ZTA_1=((PR_1, SE_1),(PR_2, SE_2)),$$

$$ZTA_2=((PR_3, SE_5),(PR_4, SE_5),(PR_4, SE_6),(PR_5, SE_7)).$$

No time reference can be produced on the contiguous partial section formed of section elements 3 and 4 because the spatial distance of these section elements from the next route reference point which is in a projection relation with the attribute "projected equals true" ($PR_2$) is unknown.

2.5 Route Reconstruction Relation FWR

The route reconstruction relation FWR comes from the ZTA relation in that the section elements $SE_{z,r}$ for every partial series $ZTA_z \in ZTA$ are put together from the ordered pairs $$P_{z,r}=(PR_{z,r}, SE_{z,r}) \in ZTA_z \text{ to form a series}$$

$$FWR_z=(SE_{z,f})_{f=1 \ldots Fz},$$

wherein identical section elements are taken into consideration in pairs only once, i.e., $$SE_{z,f+1} \neq SE_{z,f},\ z=1 \ldots Z, f=1 \ldots (F_z-1).$$

The route reconstruction FWR is the combination of all partial series $FWR_z$, i.e., $$FWR=(FWR_z)_{z=1 \ldots Z}.$$

The section elements of the route reconstruction FWR form the reconstruction of the route of the FCDGM and represent the answer to the where-question of the reconstruction problem (localization in the strict sense).

The route reconstruction for the example from Diagram 1 is:

$$FWR=(FWR_1, FWR_2),$$

$$FWR_1=(SE_1, SE_2),$$

$$FWR_2=(SE_5, SE_6, SE_7).$$

2.6 Point Reconstruction Mapping S(t)

The point reconstruction mapping S(t) assigns a point on the original route to every point on the route reconstruction FWR.

The path parameter s is used for referencing the points on the original route. In order to reference the points on the contiguous partial sections $FWR_z \in FWR$ of the route reconstruction, the path parameter t indicating the distance of a point on the partial section FWR_from the end of the partial section $FWR_z$ opposite the temporal drive-through (see Diagram 1) is introduced on every partial section. The point reconstruction mapping is accordingly divided into a family $(S_z(t))_{z=1 \ldots Z}$ of point reconstruction maps with a specific value range for path parameter t:

$$s=S_z(t),\ t \in [0, L_W],$$

$$L_{W_z} = \left.\sum_{f=1}^{F_z}\right] L(SE_{z,f}),\ SE_{z,f} \in FWR_z.$$

The point reconstruction mapping S(t) is fundamentally model-dependent. The following conditions lead to a family $(S_z(t)_{z=1 \ldots Z}$ of definite simple point reconstruction maps:

PRA1: The maps $(S_z(t)_{z=1 \ldots Z}$ are equidistant, i.e., two points $t_{z,1}$, $t_{z,2}$ on the reconstructed route having a distance $\Delta t_{z,12}=t_{z,2}-t_{z,1}$ from one another along the reconstructed route are to be mapped on two points $_{z,1}$, $S_{z,2}$ on the original route which have the same distance $\Delta s_{12}=s_2-s_1=\Delta t_{z,12}$ from one another along the original route.

PRA2: The path parameters $s_{z,e}=S(PR_{z,e})$, $e=1 \ldots E_z$ of those $PR_{z,e}$ that are a component part of the specifically ordered pairs $P_{z,e}=(PR_{z,e}, SE_{z,e}) \in ZTA_z$ of a partial series $ZTA_z \in ZTA$ with "projected $(P_{z,e})$=true" are to be mapped as accurately as possible by the point reconstruction mapping $(S_z(t))_{z=1 \ldots z}$ (according to the ZTA criteria, $E_z \geqq 1$). Quantitatively, this means that the deviations $$S_{z,e}-S_z(t_{z,e}),\ e=1 \ldots E_z$$

are to be minimized. The values $t_{z,e}$, e=1. . . $E_z$ designate the value of the path parameter t for the $PR_{z,e}$ and result from the definition of the path parameter t and the attribute $x_{z,e}$= distance $(p_{z,e})$ as follows:

$$t_{z,e}=\left(\left\{\sum_{g=1}^{e}{}' L(SE_{z,e})\right\}-x_{z,e}\right).$$

The sum is carried out over all projections $p_{z,g}=(PR_{z,g}, SE_{z,g}) \in ZTA_z$ with Index $g \leqq e$, wherein the apostrophe before the sum sign means that identical section elements $SE_{z,e}$ are taken into account pairwise only once.

The condition PRAL forces a linear statement with slope 1 for the family $(S_z(t))_{z=1 \ldots z}$ of the point reconstruction maps, i.e.,:

$$S_z(t)=Y_z+t, t \in [0,L_{w_z}].$$

The condition PRA2 represents an extreme value problem whose solution allows the axial distance Yz to be determined. The solution to the extreme value problem is equivalent to the determination of the absolute minimum of the function $$(y_z)=\sum_{e=1}^{E_z}\{s_{z,e}-S_z(t_{z,e})\}^2=\sum_{e=1}^{E_z}\{y_z-(s_{z,e})-t_{z,e}\}^2.$$

The necessary condition for the presence of a minimum is that the first derivation $$\frac{dH}{dy_z}(y_z)=2\sum_{e=1}^{E_z}\{y_z-(s_{z,e}-t_{z,e})\}$$

has a zero position with respect to $_z$. This is the case for $$y_z=\frac{\sum_{e=1}^{E_z}\{S_{z,e}-t_{z,e}\}}{E_z}.$$

Based on the equation $$\frac{d^2}{dy_z^2}H(y_z)=2\cdot E_z>0,$$

the determined $Y_z$ is actually a minimum.

Figure 5:
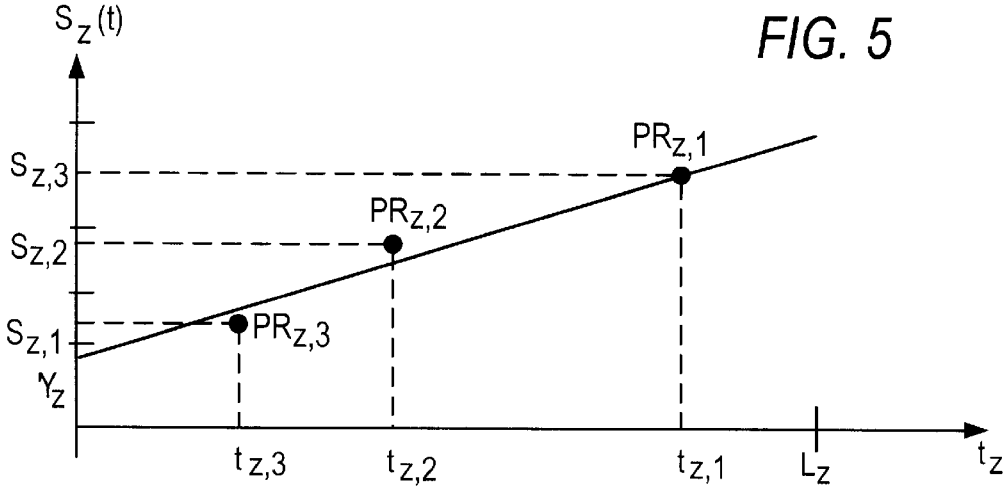
FIG. 5 is an illustration of the point reconstruction maps (Sz(t))z=1. . . Z.

The extreme value problem for determining the family $(S_z(t))_z$=1. . . z of point reconstruction maps $S_z(t)$ is illustrated in FIG. 5.

The point reconstruction maps for the example from Diagram 1 are $$S_1(t)=\mathbf{Y1}+t,\ t \in [0,L_{w_1}],$$

$$S_2(t)=\mathbf{Y2}+t,\ t \in [0,L_{w_2}],$$

with parameters $$L_{w1}=L(SE_1)+L(SE_2),$$

$$L_{w2}=L(SE_5)+L(SE_6)+L(SE_7),$$

$$y1=S(PR_1)-t_{1,1},$$

$$y_2=\frac{(S(PR_3)-t_{2,1})+(S(PR_4)-t_{2,2})}{2}$$

$$t_{1,1}=L(SE_1)-x_1,$$

$$t_{2,1}=L(SE_5)-x_5,$$

$$t_{2,2}=L(SE_5)-x_6.$$

The values $x_1$, $x_5$, $x_6$ are defined in Table 3.

3 Building of the Reconstruction from the Reconstruction Relations

Under the following subheadings, it is shown how the dynamic attributes of the section elements $SE_{z,f} \in FWR_z \in FWR$ which make up the component of the partial sections $FWR_z$ of the route reconstruction FWR can be expressed by a suitable successive connection of reconstruction relations.

3.1 Arrival Time

The arrival time for the section elements $SE_{z,f} \in FWR_z \in FWR$ is given by successive connection of the point reconstruction relation $S_z$ (t) and the time interpolation mapping T(s):

$$T(SE_{z,f})=T(s^A_{z,f}),\ f=1 \ldots F_z,\ z=1 \ldots Z,$$

$$s^A_{z,f}=S_z(t^A_{z,f}),$$

$$t^A_{z,f}=\sum_{g=1}^{f}L(SE_{z,g}),\ SE_{z,g} \in FWR_z.$$

If the value $s^A_{z,f}$ lies outside of the value range $[0,Ma(L_w, L_p)]$ for the path parameter s, then the section element under consideration is to be rejected as a component of the reconstruction.

3.2 Travel Time

The travel time for the section elements $SE_{z,f} \in FWR_z \in FWR$ from the partial sections $FWR_z$ of the route reconstruction FWR (with the exception of section element $SE_{z,1}$) can be derived in the following manner from the arrival times:

$$TT(SE_{z,f})=T(SE_{z,f-1})-T(SE_{z,f}),\ f=2 \ldots F_z,$$

$$TT(SE_{z,1})=T(y2)-T(SE_{z,1}).$$

The value $T(y_z)$ designates the value of the time interpolation mapping T(s) for $$s=S_z(t=0)=y_z.$$

3.3 Section Data Item

The spatial average $F_z$ of the driving profile for the section elements $SE_{z,f} \in FWR_z \in FWR$ from partial sections $FWR_z$ of the route reconstruction FWR is given by successive connection of the point reconstruction relation $S_z(t)$ and driving profile interpolation F(s):

$$F_{z,f} = \frac{1}{L(S_{E_{z,f}})}\int_{t^A_{z,f}}^{(t^A_{z,f}+L(S_{E_{z,f}}))} F(S_z(t'))\,dt',\ 0$$

$$t^A_{z,f} = \sum_{g=1}^{f} L(S_{E_{z,g}}),\ S_{E_{z,g}} \in FWR_z 0.$$

Note: The Section Data Item "average speed" can be obtained by dividing the length of the section element by the travel time.

What is claimed is:

1. A method for efficiently transmitting location data impliciting a location of a terminal unit in a traffic network at a point in time and general measurement data impliciting other characteristics of the traffic network at at least one of a location and a time to a central traffic station, which location data and general measurement data are detected by a terminal unit for a vehicle, comprising the steps of:

transmitting at least some data records from the terminal unit to the central traffic station which contain only location data;

independently transmitting some data records from the terminal unit to the central traffic station which contain only general measurement data other than location data; and compressing the location data and the general measurement data separately from one another according to different compression methods prior to transmitting.

2. A method according to claim 1, wherein the data records have different data record lengths which are determined by an extent of data to be transmitted.

3. A method according to claim 2, wherein the transmitting is carried out via mobile radio.

4. A method according to claim 1, including providing the location data records and the measurement data records with at least one of different location referencing and different time referencing.

5. A method according to claim 1, further including referencing a data record with only location data by one of a location and a location area.

6. A method according to claim 1, further including referencing a data record by one of a time and a time range.

7. A method according to claim 1, further including referencing transmitted data records with respect to positions in a digital map of the traffic network in the central station.

8. A method according to claim 1, wherein the transmitting is carried out via radio.

9. A method according to claim 1, including initiating the transmitting of measurement data when an event of a predeterminable type occurs.

10. A method according to claim 1, including carrying out the transmitting of a data record when the terminal unit passes a predeterminable location.

11. A method according to claim 1, including carrying out a transmitting of location data when there is one of a change in direction of the terminal unit to a predeterminable extent, and there is an absence of a curve in a digital map in the terminal unit at a location of the change in direction.

12. A method according to claim 1, wherein the compressing includes a redundancy reduction of data.

13. A method according to claim 1, wherein the compressing includes a redundancy reduction of data along one of daily, weekly and yearly progress lines.

14. A terminal unit, comprising:

a program for efficiently transmitting compressed location data impliciting a location of a terminal unit in a traffic network at a point in time and compressed general measurement data impliciting other characteristics of the traffic network at at least one of a location and a time to a central traffic station, the general measurement data being compressed differently from the location data, which location data and general measurement data are detected by a terminal unit for a vehicle, at least some data records transmitted from the terminal unit to the central traffic station contain only location data, and some data records transmitted from the terminal unit to the central traffic station contain only general measurement data other than location data;

a processor for running the program;

a storage for the program; and a communications module for conveying information to the central traffic station.

15. A terminal unit according to claim 14, and further comprising a GPS position detection device.

16. A terminal unit according to claim 14, and further comprising a digital map.

17. A terminal unit according to claim 14, and further comprising sensors operative to detect and output data about at least one of vehicle speed, sections traveled by the vehicle, position, outside temperature, and time.

18. A central traffic station, comprising:

a program for efficiently transmitting compressed location data impliciting a location of a terminal unit in a traffic network at a point in time and compressed general measurement data impliciting other characteristics of the traffic network at at least one of a location and a time to a central traffic station, the general measurement data being compressed differently from the location data, which location data and general measurement data are detected by a terminal unit for a vehicle, at least some data records transmitted from the terminal unit to the central traffic station contain only location data, and some data records transmitted from the terminal unit to the central traffic station contain general only measurement data other than location data;

a storage for the program;

a process for running the program; and a communications module for reception of information from the terminal unit in the vehicle.

19. A central traffic station according to claim 18, and further comprising a digital map of the traffic network.

20. A central traffic station according to claim 18, and further comprising means for storing data records transmitted from the vehicle.

* * * * *